US005396860A

United States Patent [19]

Cheng

[11] Patent Number: 5,396,860

[45] Date of Patent: Mar. 14, 1995

[54] SWIMMING PROPELLING DEVICE

[76] Inventor: Lior L. Cheng, 7, Yon-Zun Rd., San-Chung City, Taiwan, Prov. of China

[21] Appl. No.: 99,065

[22] Filed: Jul. 29, 1993

Related U.S. Application Data

[63] Continuation-in-part of Ser. No. 934,729, Aug. 24, 1992, abandoned.

[51] Int. Cl.[6] ..... B63C 11/46

[52] U.S. Cl. ..... 114/315; 440/6

[58] Field of Search ..... 441/65, 74; 440/6; 114/39.2, 312, 315, 337, 338, 352

[56] References Cited

U.S. PATENT DOCUMENTS

| | | | |
|---|---|---|---|
| 2,722,021 | 11/1955 | Keogh-Dwyer | 114/315 |
| 3,442,240 | 5/1969 | Wild et al. | 114/315 |
| 3,536,025 | 10/1970 | Tierney | 440/6 |
| 4,598,659 | 7/1986 | Chinnery | 114/39.2 |
| 4,811,682 | 3/1989 | Hwang et al. | 440/6 |
| 4,840,592 | 6/1989 | Anderson | 441/65 |
| 5,105,753 | 4/1992 | Chih et al. | 114/315 |

FOREIGN PATENT DOCUMENTS

| | | | |
|---|---|---|---|
| 1554862 | 1/1969 | France | 440/24 |

*Primary Examiner*—Stephen P. Avila

*Attorney, Agent, or Firm*—James A. Drobile; Lois A. Gianneschi

[57] ABSTRACT

A propelling device comprises a floating plate and an attached floating body. The floating plate has a hole surrounded by a flange at the upper part, the flange provided along the two sides of the floating body sit on the flange of the floating plate. An electric ON/OFF switch is fixed on the floating body to control a motor provided to drive a propeller, besides, a speed switch is provided to control the speed of the motor.

4 Claims, 6 Drawing Sheets

SWIMMING PROPELLING DEVICE

Field of The Invention

This application is a (continuation in part) of U.S. Ser. No. 07/934,729, filed on Aug. 24, 1992, now abandoned by the same applicant. This invention relates to a propelling device, more particularly a propelling device for swimming, submerging or other water sports.

BACKGROUND OF THE INVENTION

The wage of hiring a diver may take hundreds or even up to thousand U.S. dollars per hour, and by using the propelling device of this invention, any person (if his/her physical condition allows) can embrace the device and do the work.

The unique feature of this case is to design a propelling device mainly made from EVA (ethylene vinyl acetate) and is bound with chest and to be in unity with the user, thus without rudder the user can swim in any style and have two hands free either during swimming or submerging, particularly when submerging, so that the user can do some work, for instance checking the surface situation of a ship hull or the propeller of a merchant ship, cleaning or even achieve under-water welding work. The invention has been tested numerously, particularly for submerging, and is proved reliable, excellent and successfully.

The invention is ready to be exported to U.S.A. with a cheap and reasonable price, so that every sea lover can enjoy swimming and submerging. Particularly, it is a gospel for a merchant ship owner, who usually is reluctant of cleaning ship hull for its high expanse. Now many sailors can be distributed with this invention to clean the hull to save tremendous energy consumption due to friction of ship hull with water.

Some prior arts have been granted patents in USA, such as

1. U.S. Pat. No. 5,105,753 of "Multi-purpose underwater propelling device" by Chih et al.
2. U.S. Pat. No. 4,811,682 of "Mini inflatable yacht" by Hwang et al.
3. U.S. Pat. No. 2,722,021 of "Surface and sub-surface human being propulsion device" by W. C. Keogh-Dwyer.
4. U.S. Pat. No. 4,840,592 of "Power driven underwater viewing platform" by A. B. Anderson.
5. U.S. Pat. No. 3,536,025 of "Motorized surfboard" by Tireney.
6. U.S. Pat. No. 3,442,240 of "Power swimming aid" by F. J. Wild et al.

Except the one of Keogh-Dwyer, none of abovesaid prior art can achieve the abovesaid object, like under water welding, which requires a firm hand to weld the ship accurately.

Besides, since no rudder is needed, the structure is the simplest compared with all the Granted patents (except "Sailboard with removable floats" by Chinnery) and the propelling direction can be easily controlled by turning his own body.

Though Chih et al. of U.S. Pat. No. 5105753 discloses a swimming propelling device (FIGS. 3, 4-1) with a floating body 10, a battery 24, a motor 22, switch 55, and a re-charging outlet 132, the abovesaid unique features of (1). Let two hands free in order to work; (2) omissions of the rudder are not found in the prior arts of Chih.

Though Keogh is the only reference which has similar objects as this case, the structure of Keogh is much more complicated. Accordingly, the cost will surely be much more expansive than this case. Besides, a gas release valve, a water entry and escape valve, a gas pressure chamber, means connecting said gas pressure chamber, a control valve . . . are provided in the said Keogh, the more complicated the structure is, the more problems will occur. The cost of the Keogh is unknown; however, since its structure and working principle correspond to a submarine, the applicant estimates the cost ratio between two inventions can be roughly estimated as the one between a submarine and a simple powered canoe. Thus the invention can be manufactured in a much cheaper price.

Concerning the flexible and waist strap, there is still difference therebetween, the strap of this invention utilizes push button type, so that in case of emergence, a user can instantly give up the propelling device by just pushing the button. However, if the examiner insists that the design thereof is obvious, the applicant is willing to remove this strap from the protected scope.

The combination of Chih et al. and Keogh-Dwyyer falls short of applicant's invention because it could not be used under water to let two hands free.

Hwang of U.S. Pat. No. 4811682 discloses a swimming propelling device including a flange and a float 23. Not disclosed by Hwang is a float in the form of a foam plate, a connecting slot, and an on/off switch.

The flanges of this invention are provided along the two sides of the floating body, which can also have the function of stabilization when being used under water, however the flange of Hwang is provided along the inner side of inflatable bladder which can not be used underwater and merely for engagement. Similarly the float member 28 of Keogh-Dwyer could not be used along.

Though this invention can be utilized for swimming, it is particularly useful for submerging work. However, the function and object of the invention "Power driven underwater viewing platform" by Anderson is different from this invention, same for the inventions of Tierney, Bonafous and Wild et al.

SUMMARY OF THE INVENTION

The object of this invention is to provide a convenient propelling device. A swimmer can lie down on the floating plate and the motor will drive the device to where the swimmer wants to go. If he wants to scuba dive, the driving propeller can also help relieve the burden of a diving apparatus such as oxygen tank.

Another object of this invention is to provide a swimming propelling device, wherein the floating plate can be removed easily and instantly by pulling up the floating body which sits on the floating plate. The floating body which is driven by a motor can be bound around the swimmer's chest by a flexible A further object of this case is to provide a reliable switch to control "ON" and "OFF" of motor for swimming or diving respectively. Besides, a two speed switch is provided for controlling the speeds of the motor.

For a better understanding of the invention, the operating advantages and specific objects attained by its use, reference shall be made to the accompanying drawings.

DETAILED DESCRIPTION OF THE INVENTION

Figure 4:
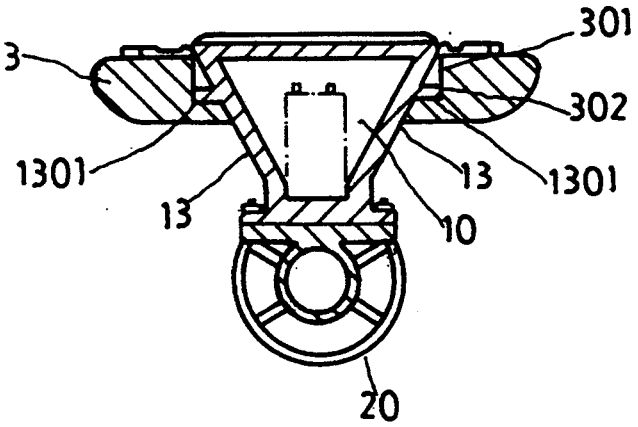
FIG. 4 is a cross-sectional view cut along line II-II of FIG. 1, used to show the engaging relationship therebetween.

Now referring to FIGS. 1,2,3 and 4 , the propelling device comprises of a floating body 10 with an enclosed space, which can form a hollow body made of light and strong material, wherein the necessary power supply such as a batter (as shown in FIG. 4) can be stored. The front end of the body 10 may be streamlined to facilitate water-breaking. The top surface of the floating body may be designed to conform with the shape of the user's chest. Two fasteners 151*a*151*b*, are provided on the front top of the floating body 10.

A motor 22 is provided under floating body 10 which stores a battery to supply power to drive a propeller 23 provided behind the motor. A sealing cover 21 is provided outside motor 22 to form a sealed exterior for the propelling device 20. Except for discharging channel 211 provided neighboring the periphery of the propeller and water inlet 212, the rest of the device should all be sealed in the sealing cover 21.

A flange 1301 in (FIG. 4) formed along the side wall 13 of the floating body near the top can sit on flange 303 of the floating plate 3. Accordingly, the floating plate can support the heavier floating body. However, to avoid any accidental impulse working on the floating body, a fastener (not shown) can be provided to bind the two together.

Figure 1:
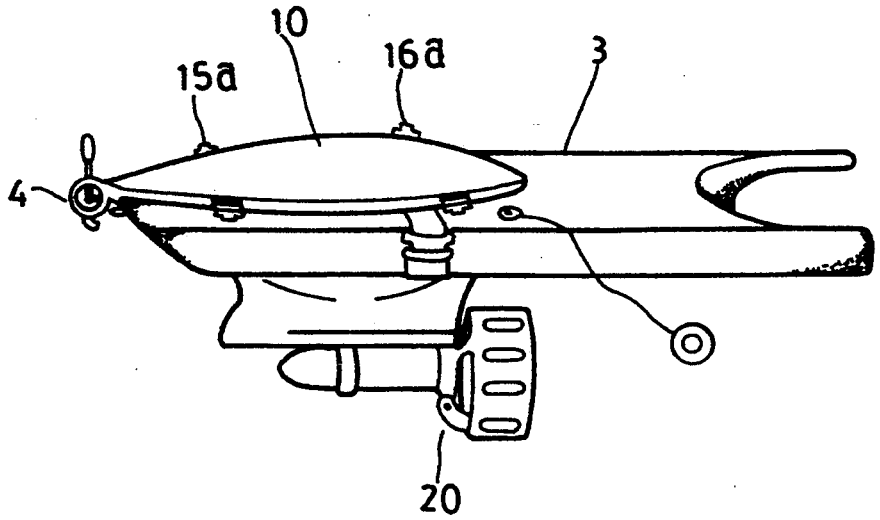
FIG. 1 is a perspective view of the floating body with floating plate of the invention.
Figure 3:
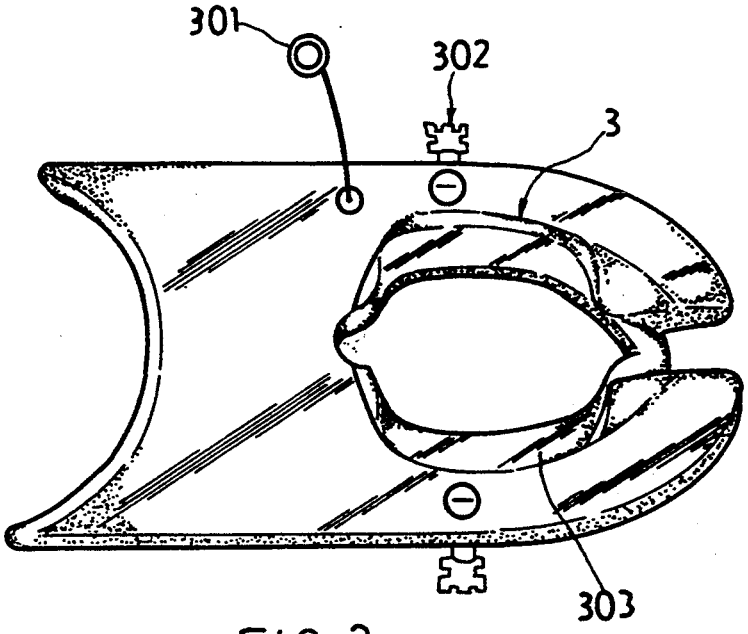
FIG. 3 is a perspective view of the floating plate thereof.
Figure 2:
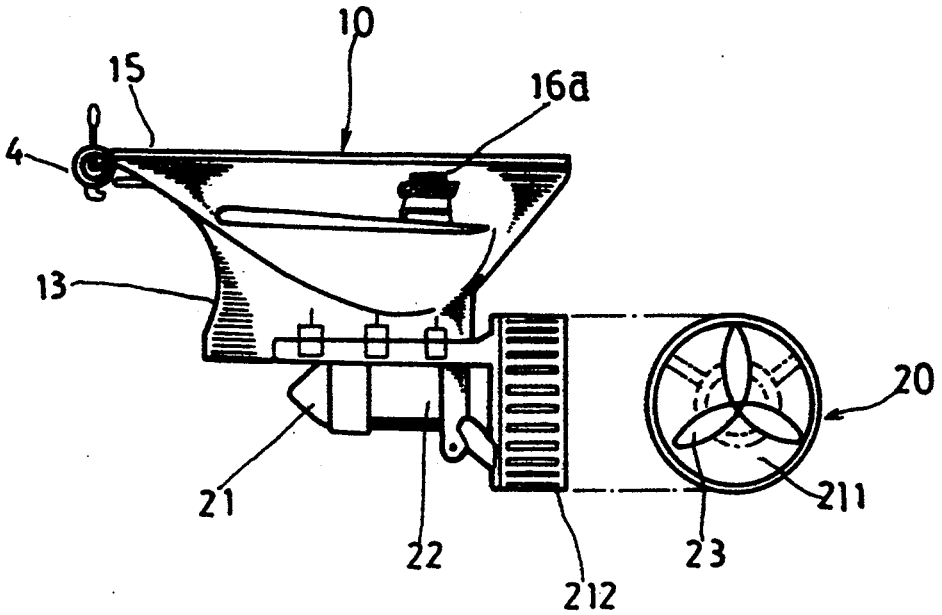
FIG. 2 is a side view of the floating body thereof.
Figure 5A:
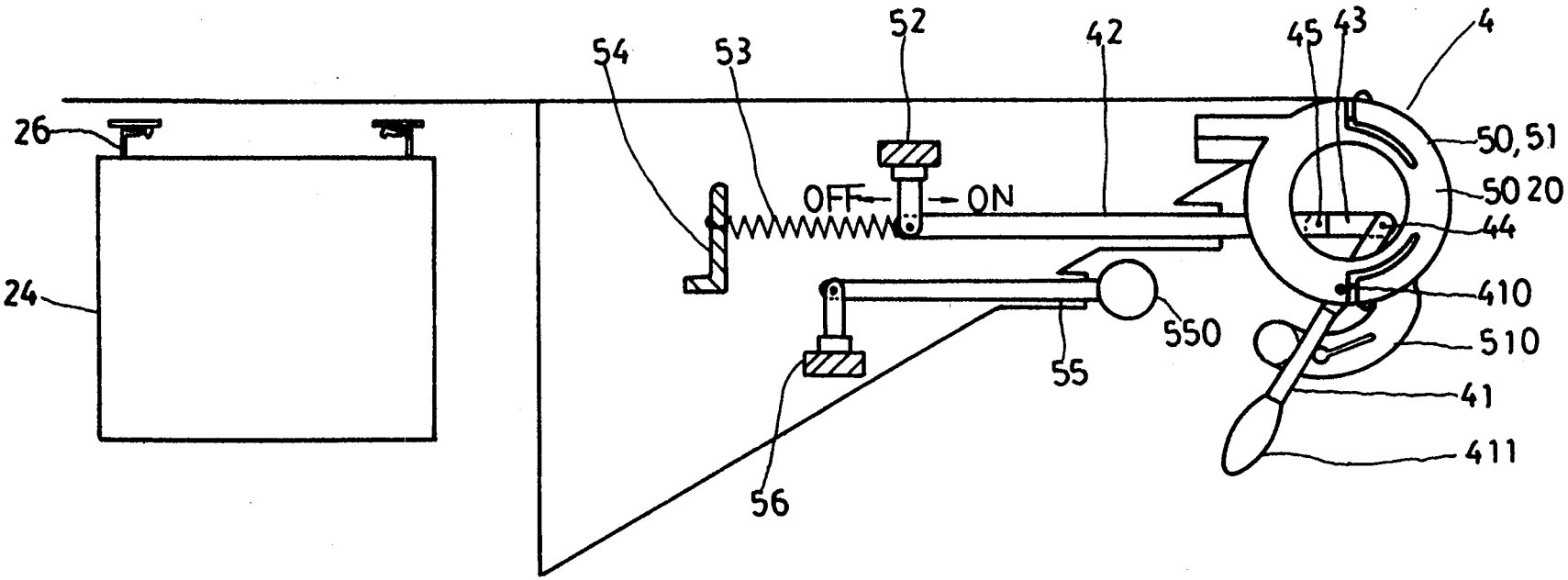
FIG. 5A is a side view of the control devices provided at the front part of the floating body.
Figure 5B:
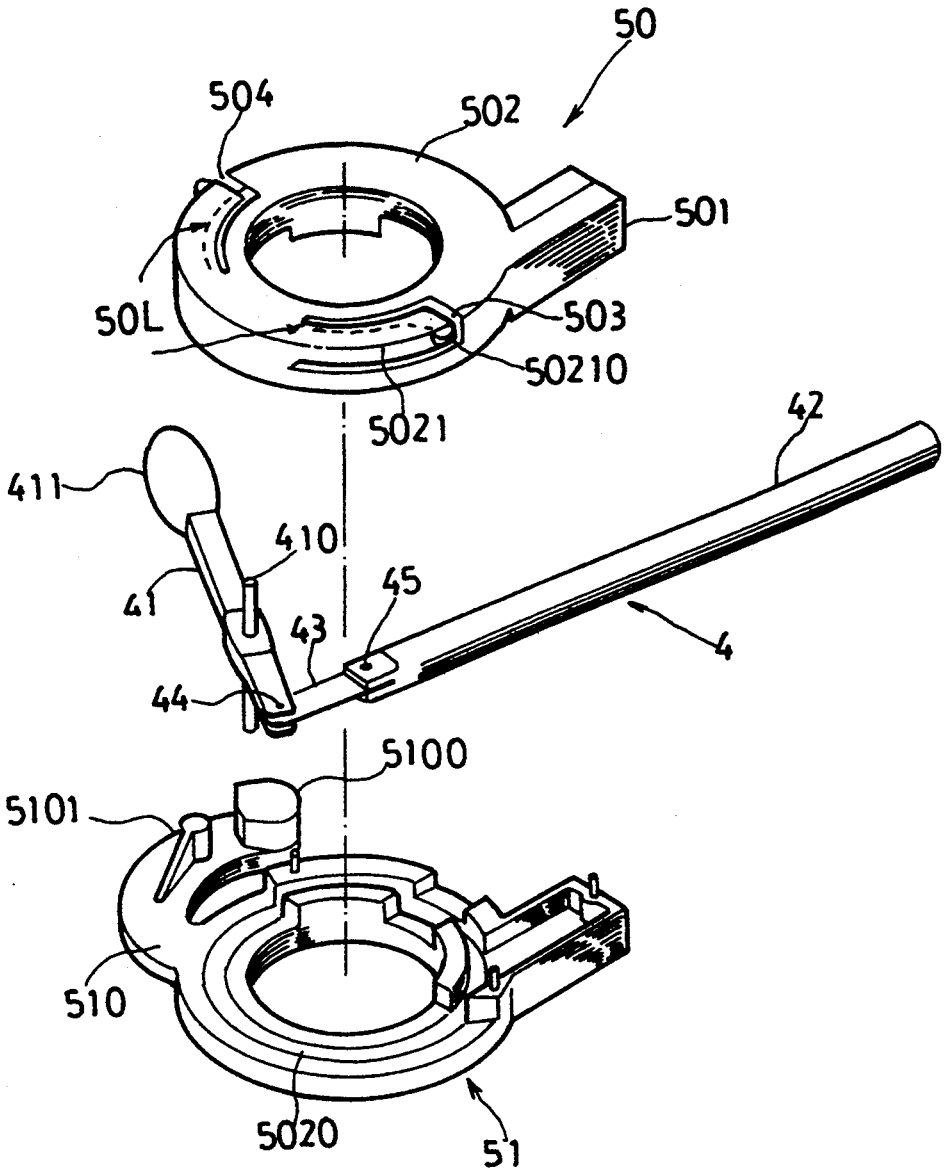
FIG. 5B is an exploded view of the ON-OFF switch.

According to this invention, the configuration shown in FIG. 1 is suitable for surface swimming. When the swimmer lies on the floating plate 3, power is supplied propelling device 20 by use of the ON-OFF electric switch 4, (in FIG. 5A) so that the floating body, floating plate and swimmer can be pushed forward. The speed of the motor can be controlled by another speed switch 55. The detailed structure of switch 4 is shown in FIG. 5B, wherein it is fixed on the floating body 10, The electric switch means comprises a control lever 41 including a locking pin 410 and a knob 411 formed at one end of the lever;

a pull rod 42, one end of which is connected to a motor switch 52 in the floating body for operating the switch to be in "ON" or "OFF" position, through the operation of the control lever 41 thereby controlling the "ON" or "OFF" of the motor power;

a link 43 as a connection between the control lever 41 and pull rod 42;

a pin 44 provided at the other end of the control lever 41 for a connection of the control lever 44 and link 43; and a pin 45 provided at the other end of the pull rod 42 for a connection of the pull rod 42 and link 43; accordingly both the control 1ever 41 and pull rod 42 can be pivotably operated;

a base 50 and a base 51 are engagably combined for guiding the operation of the control lever 41 of the switch 4;

the base 50 comprises a connection portion 501 for connecting the base 50 to the floating body, and a circular portion 502 which includes a slide slot 5020 formed, for example, concentrically with the circular portion 502 so as to guide the locking pin 410 to slide along the slide slot 5020; a stopper 5021 formed adjacent to a position 503 at which the locking pin 410 can be held for surface swimming, the stopper being a part of the bottom of the base 50 and including one section of the slide slot 5020 , on the stopper a projection 50210 is provided near the position 503 on the base wall of the slot and widened inclined by upward and toward the position 503, thereby stopping the locking pin 410 after this pin slides to the position 503, and a protrusion 50211 is provided on side wall of the base 50, with which protrusion a user can force the stopper 5021 to bend outwardly by his or her hand to let the locking pin 410 go out of the position 503; and other corresponding constructions or members related to a position 504 at which the locking pin 410 can be stopped for submerging. Furthermore, a recess 5022 is formed on top of the base 50 along circumference of the circular portion 502 from the position 503 to 504 for the control level 41 to slide through and a recess 5023 is formed similarly to accommodate the pull rod 42;

a base 51 has symmetric construction as base 50 except that the two stoppers as in the base 50 is not necessary in the base 51 and a stopper 510, which is different from said two stoppers, is provided on side wall of the base 51 for submerging; a projection 5100 and a projection 5101 are formed on the stopper 510, and the control lever 41 can be held between these two projections for the use of submerging; the base 50 and base 51 are engagably assembled for accommodating the switch 4;

some associated power control devices are provided in the floating body 10, including a switch 52 for turning "ON" or "OFF" of the motor power; a returning spring 53, one end of which is connected to the pull rod 42 and at the linkage the switch 52 is connected to the spring 53 and rod 42, so as to force the switch 52 at "OFF" position when the power is not required; a fixing rod 54 for fixing the other end of the spring 53; a pull rod 55 for selecting the speeds of the propelling device, at one end of the rod a knob 550 is provided; and a switch 56 connected to the other end of the pull rod 55 for switching between two speeds of the motor;

when the control 1ever 41 is stopped at position 503 to operatively put the switch 52 at the "ON" position to turn on the motor, the propelling device can be used for surface swimming; when the control lever 41 is held at position 504 to operatively put the switch 52 at the "ON" position to turn on the motor, said propelling device can be used for submerging; once the control lever 41 is forced to pivotably move out the position (503) or (504), the Switch 52 is put at "OFF" position by the returning spring 53 connected to the switch 52 to cut off the electrical power for the motor.

Figure 5C:
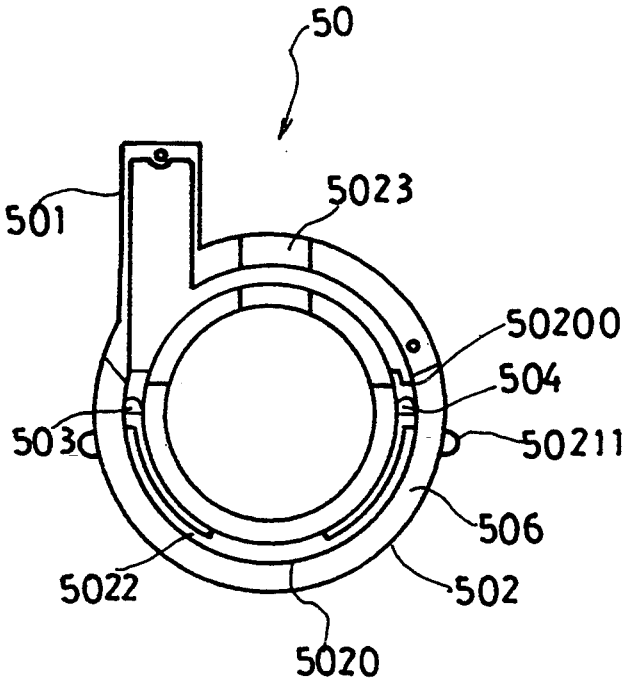
FIG. 5C is the top view of ON-OFF switch of disengaged base turned over.
Figure 6:
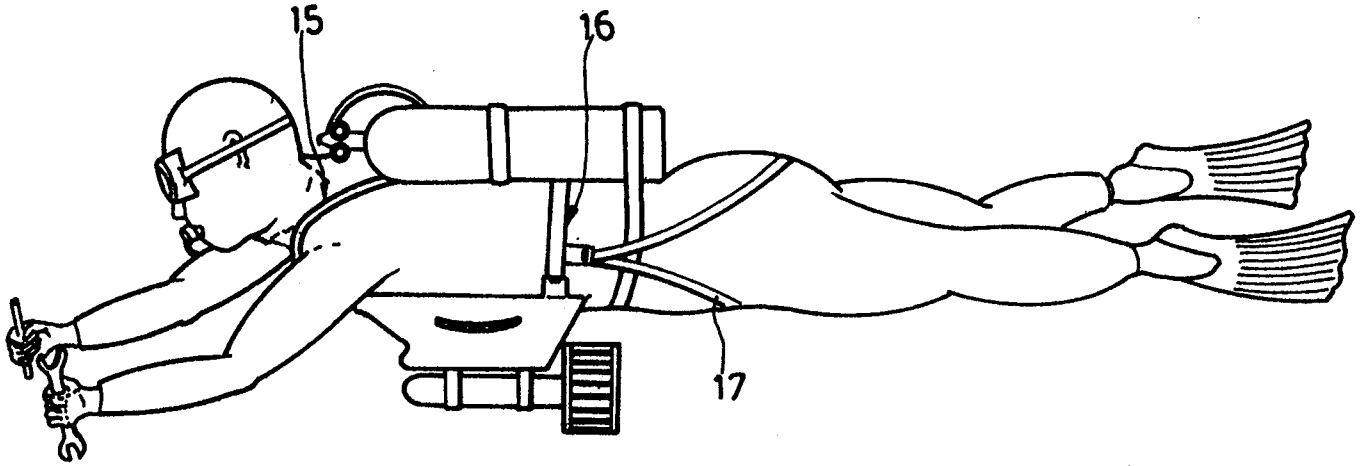
FIG. 6 is a perspective view of a scuba diver wearing the floating body.

If the swimmer wants to scuba dive by means of floating body 10, the floating plate 3 is no longer necessary and can be detached from floating body 10. Meanwhile, the diver should move the control lever 41 and lock it into position 504 shown by FIG. 5. Then as shown by FIG. 1 and 6, the locking fastener 15*a* and strap 15 fixed on top of floating body 10 can hook the floating body 10 to the neck of the user's neck. The floating body can be bound to the user's waist by means of waist strap 16 and locking fastener 16*a* and, around the upper part of both the user's legs by means of strap 17, of which the other end is also bound at waist strap 16 Thus the hanging position of surface swimming can be accomplished Now the diver can pivotably move the control lever 41 to the position of 504 for diving or submerging purpose. Now the user's hands are freed, since the swimming propelling device 20 can rotate alone continuously, and the diver can concentrate on diving meanwhile, the flange at the two sides of the floating body can provide additional balance. Should the swimming propelling device 20 break down, the diver can release the locking fasteners 15*a* to set free the strap 15 and the waist strap 16 automatically and remove floating body 10 away from the diver. Since the structure of the locking fastener is conventional, it will not be described here.

The positive and negative terminals of the battery are connected by elastic flaps 26 respectively, so that the terminals can touch the power source without using bolt or nut. The electric wiring of the Bower supply, switch and motor are conventional and thus will not also be repeated here. The battery can also be provided with an electric plug so that it can be charged at any time without the use of a wire. The most important thing to ensure is the water-tightness of the whole body, and since the means are also conventional they will not be described here.

The embodiment described above is given for description only, and any one skilled in this art can make various modifications without departing from the spirit of this invention. All modifications will be deemed as falling in the category of the following claims.

I claim:

1. A swimming propelling device, comprising:

a floating body (10) having a space enclosed by a top wall, two curved side walls, a removable bottom wall;

a motor (22) secured under said bottom wall and connected with a propeller (23) surrounded by a guard (212);

two flanges (1301) formed respectively along said two curved side walls to facilitate balancing when submerging;

a battery (24) being mounted on said removable bottom wall of said floating body (10) in order to store and supply power to drive said motor (22);

power control devices mounted at the bow of said floating body to control ON-OFF and the speed of motor, including a switch (4) to control ON-OFF of said motor and facilitate either swimming or submerging;

a neck strap (15) and a waist strap (16) provided for binding said floating body with a user;

a plurality of locking fasteners (15*a*, 16*a*) fixed on said floating body so that said flexible neck strap (15) and said waist strap (16) or tight strap (17) can be removed from said floating body instantly; characterized in that a floating plate (3) having a hole and two flanges (303) formed respectively along two sides of the periphery of the hole to mate with the two flanges (1301) of said floating body (10), so that the flanges (1301) of said floating body can sit exactly on the flanges (303); thus floating body (10) can be either used alone as a underwater propelling device or can also sit on said floating plate (3) to facilitate swimming, and both can be bound together by a strap (302), and the floating body (3) is connected with a user's wrist by a string with a ring (301) at the end thereof.

2. A swimming propelling device according to claim 1, wherein said switch (4) comprises a control lever (41) having a locking pin (410) and a head knob (411);

a pull rod (42), one end of which is connected to a motor switch (52) for operating the switch in "ON" or "OFF" position, through the operation of the control lever (41) thereby controlling the "ON" or "OFF" of motor power;

a link (43) as a connection between the control lever (41) and a pull rod (42);

a pin (44) provided at the other end of the control 1ever (41) to connect the control lever (44) and link (43); a pin (45) provided at the other end of the pull rod (42) to connect the pull rod (42) and link (43); thereby both the control lever (41) and pull rod (42) are pivotably operated;

a base (50) and another base (51) engagably combined to guide the operation of the control lever (41) of the switch (4); and the base (50) comprises a connection portion (501) for connecting the base (50) to the front of floating body (10); a circular portion (502) having a slide slot (5020) formed concentrically with the circular portion (502) so as to guide the locking pin (410) to slide along the slide slot (5020);

a stopper (5021) formed adjacent to a position (503) at which the locking pin (410) is locked for surface swimming, the stopper (5021) being a part of the bottom of the base (50) and including one section of the slide slot (5020), on the stopper a projection (50210) is provided near the position (504) on the base wall of the slot and widened inclinedly (as shown by dotted line 50L) toward the post (503), thereby locking the locking pin (410) after this pin slides to the position (503), with which protrusion a user can lift the stopper (5021) to bend outwardly with a finger to push the locking pin (410) out therefrom; and other corresponding constrictions or members is a position (504), whereat the locking pin (410) can be locked for submerging;

a recess (5022) formed in the base (50) along circumference of the circular portion (502) from the position (503) to position (504) for the control lever (41) to slide through and a recess (5023) is formed to accommodate the pull rod (42);

a base (51) having almost symmetric construction as base (50) except that the two stoppers in the base (50) are not necessary, whereas a bottom stopper (510) is provided on side wall of the base (51) for submerging;

a projection (5100) and a projection (5101) formed on the stopper (510) to hold the control lever (41) therebetween.

3. A swimming propelling device according to claim 1, wherein said power control devices comprising an electric switch (52) for turning "ON" or "OFF" of motor power;

a returning spring (53), one end of which is connected to a pull rod (42) and at a linkage said switch (52) is connected to said spring (53) and a rod (42), so as to pull back said switch (52) at "OFF" position when power is not required;

a fixing rod (54) to fix the other end of said spring (53);

a pull rod (55) for selecting the speeds of the motor, at one end thereof a knob (550) is provided;

an electric switch (56) connected to the other end of the pull rod (55) for switching between speeds of the motor;

when the control lever (41) is locked at position (503) to operatively put the switch (52) at "ON" position, the propelling device is used for surface swimming; when the control lever (41) is locked at position (504) to operatively put the switch (52) at the "ON" position (504) to turn on the motor, and said propelling device is used for submerging;

once the control lever (41) is forced to move out of either position (503) or (504), the switch (52) is pulled back to "OFF" position by the returning spring (53) to cut off power to the motor.

4. A propelling device according to claim 1, wherein the battery (24) has elastic flap terminals (26), so that the battery (24) can be pushed into the enclosed space of floating body directly to contact power source without using nut or bolt for connection of terminals.

* * * * *